US006820965B2

(12) United States Patent
Clippingdale et al.

(10) Patent No.: US 6,820,965 B2
(45) Date of Patent: Nov. 23, 2004

(54) DROP-ON-DEMAND PRINTER

(75) Inventors: Andrew John Clippingdale, Cambridge (GB); Daniel Richard Mace, Cambridge (GB); Simon Roger Johnson, Middlesex (GB); Guy Charles Fernley Newcombe, Cambridge (GB)

(73) Assignee: Tonejet Limited, Hertfordshire (GB)

( * ) Notice: Subject to any disclaimer, the term of this patent is extended or adjusted under 35 U.S.C. 154(b) by 0 days.

(21) Appl. No.: 10/466,629

(22) PCT Filed: Jan. 17, 2002

(86) PCT No.: PCT/GB02/00193

§ 371 (c)(1),
(2), (4) Date: Jul. 18, 2003

(87) PCT Pub. No.: WO02/057086

PCT Pub. Date: Jul. 25, 2002

(65) Prior Publication Data

US 2004/0051770 A1 Mar. 18, 2004

(30) Foreign Application Priority Data

Jan. 18, 2001 (GB) ..... 0101353

(51) Int. Cl.[7] ..... B41J 2/06; B41J 2/02
(52) U.S. Cl. ..... 347/55; 347/73
(58) Field of Search ..... 347/74, 5, 55, 347/79, 73

(56) References Cited

U.S. PATENT DOCUMENTS 6,412,915 B1 * 7/2002 Muramatsu et al. ..... 347/55

FOREIGN PATENT DOCUMENTS

| | | | | |
|---|---|---|---|---|
| JP | 04080054 A | * | 3/1992 | ..... B41J/2/415 |
| JP | 10337872 | | 12/1998 | |
| JP | 2000025236 | | 1/2000 | |
| JP | 2001001524 | | 1/2001 | |
| JP | 2001030498 A | * | 2/2001 | ..... B41J/2/06 |
| WO | 98/32609 | | 7/1998 | |

* cited by examiner

*Primary Examiner*—Stephen D. Meier
*Assistant Examiner*—Alfred Dudding
(74) *Attorney, Agent, or Firm*—Dykema Gossett PLLC

(57) ABSTRACT

A drop-on-demand printer having a row of ink ejection locations (2) for ejecting plural ink droplets, each ejection location (2) having an associated ejection electrode (40) to which a voltage is applied for causing electrostatic ejection of the droplets from the respective ejection location (2); a guard channel (5) disposed between adjacent ejection locations (2), each guard channel (5) having an electrode (50) disposed therein; and control means for applying a voltage to said guard channel electrodes (50), said applied voltage being the average of the voltages applied in operation over a given time to the adjacent ejection location electrodes.

14 Claims, 3 Drawing Sheets

DROP-ON-DEMAND PRINTER

The present invention relates to a drop-on-demand printer of the type in which an agglomeration of particles is created and then ejected, by electrostatic means, onto a printing substrate. More particularly, the invention relates to such a printer having a row of ink ejection locations for ejecting plural ink droplets, such as described in our WO-A-93-11866.

Such printers may be manufactured with very small spacings between adjacent ink ejection locations, in which case, it is desirable to reduce electrostatic cross-talk between adjacent locations or channels. This can be achieved by incorporating guard channels between pairs of ejection channels. Such printers are usually operated by means of a bias voltage applied continuously to the ejection locations through appropriat ejection electrodes and, when ejection is required, applying suitable pulse voltages to the ejection electrodes. The bias voltage may also be continuously applied to the guard channels. However, when the ejection electrodes associated with two or more adjacent ejection locations are pulsed continuously, a high field is created between the ejection locations and the intervening guard channels and fluid may be forced from the ejecting n locations to the guard channels and from there may be ejected onto the substrate. It is desirable therefore to reduce the possibility of such erroneous ejection.

According to the present invention therefore there is provided a drop-on-demand printer having a row of ink ejection locations for ejecting plural ink droplets, each ejection location having an associated ejection electrode to which a voltage is applied for causing electrostatic ejection of the droplets from the respective ejection location; a guard channel disposed between adjacent ejection locations, each guard channel having an electrod disposed therein; and control means for applying a voltage to said guard channel electrodes, said applied voltage being the average of the voltages applied in operation over a given time to the adjacent ejection location electrodes.

A second aspect of the invention includes a drop-on-demand printer having a row of ink ejection locations for ejecting plural ink droplets, each ejection location having an associated ejection electrode to which a voltage is applied for causing electrostatic ejection of the droplets from the respective ejection location; a guard channel disposed between adjacent ejection locations, each guard channel having an electrode disposed therein; and control means for applying a voltage to said guard channel electrodes, said applied voltage being the average of the voltages applied in operation over a given time to the ejection location electrodes.

The control means also preferably applies a bias voltage to the guard channel electrodes with which the average voltage is summed. Also preferably, each guard channel electrode is connected to a bias voltage through a capacitance. Similarly, each guard channel electrode may be connected to the adjacent ejection location electrodes through resistances of equal value.

The invention also includes a method of operating a drop-on-d mand inkjet printer having a row of ink ejection locations for ejecting plural ink droplets, each ejection location having an associated ejection electrode for causing electrostatic ejection of the droplets from the respective ejection location, and a guard channel disposed between adjacent ejection locations and having an electrode disposed therein, the method comprising applying a voltage to said guard channel electrodes, said applied voltage being the average of the voltages applied in operation over a given time to the adjacent ejection location electrodes.

Further, the invention includes a method of operating a drop-on-demand ink jet printer having a row of ink ejection locations for ejecting plural ink droplets, each ejection location having an associated ejection electrode for causing electrostatic ejection of the droplets from the respective ejection location, and a guard channel disposed between adjacent ejection locations and having an electrode disposed therein, the method comprising applying a voltage to said guard channel electrodes, said applied voltage being the average of the voltages applied in operation over a given time to the ejection location electrodes.

The invention also includes a drop-on-demand printer having a row of ink ejection locations for ejecting plural ink droplets, each ejection location having an associated ejection electrode to which a voltage is applied for causing electrostatic ejection of the droplets from the respective ejection location; a plurality of guard channels disposed between adjacent ejection locations, each guard channel having an electrode disposed therein; and control means for applying a voltage to at least some of said guard channel electrodes.

Two examples of printers according to the present invention will now be described with reference to the accompanying drawings in which.

Figure 1:
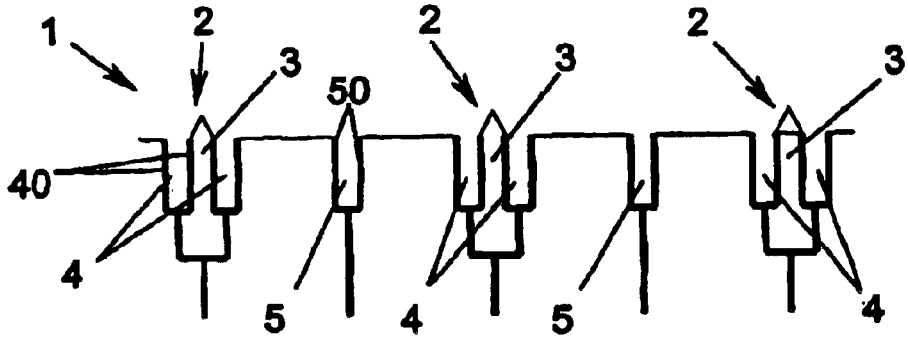
FIG. 1 illustrates a print head of the type described in our WO-A-98-32609.

FIG. 1 shows a cross-section through part of a multi-channel ejection print head 1, the figure showing three ejection locations 2, defined by upstands 3, on each sid of which is provided an ejection channel 4 having an ejection electrode 40 as described in our WO-A-98-32609, for example. Guard channels 5 are provided between each pair of ejection locations, i.e., on each sid of each ejection location 2 and have similar electrodes 50.

Figure 2:
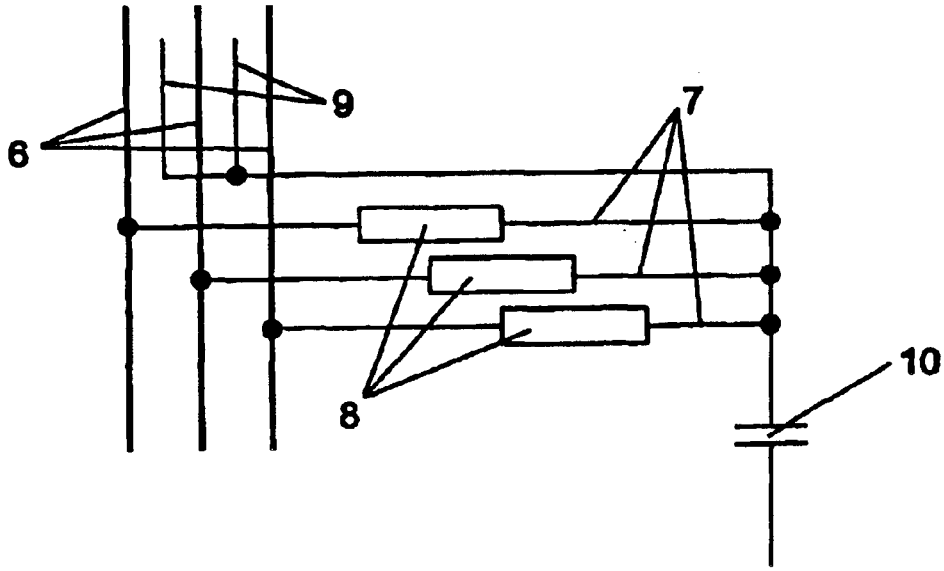
FIG. 2 illustrates the electrical connections to the ejection channels and guard channels of the printer shown in FIG. 1.

FIG. 2 illustrates the electrical connections to both the ejection channels 4 and the guard channels 5, the electrical paths 6 (ejection conductors) to the ejection channels being connected to suitable voltage drivers (not shown in FIG. 2), and having connections 7 which include a 100MΩ resistance 8 as shown, connected to each guard channel conductor 9. A bias voltage is continuously applied through a 100 pF capacitance 10 so that, as the required pulses are applied to the ejection conductors 6, appropriate RC-averaged voltages are applied to the guard channels 5. This method is suitable for providing the required voltages where the guard channels are connected together.

Figure 3:
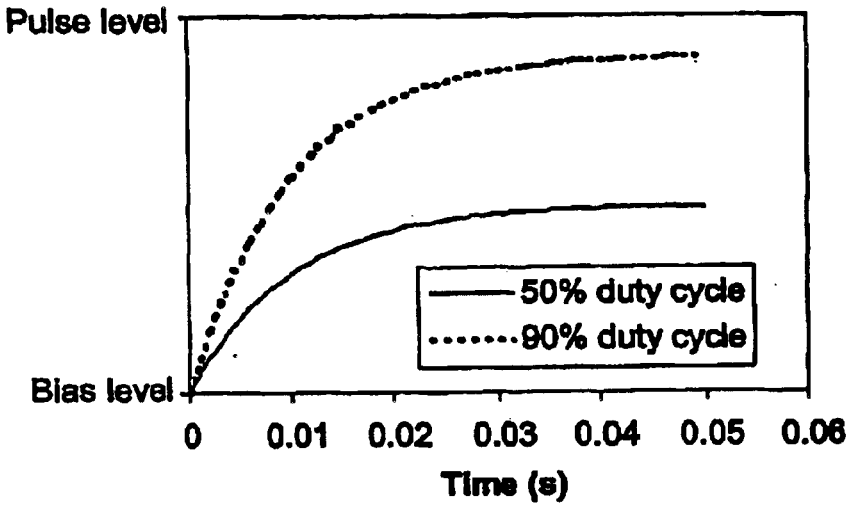
FIG. 3 illustrates the relationship over time of the voltages on the guard channels.

The circuit shown above has a time constant of 10 ms and when not printing, the guard channels 5 are all held at the bias voltage. When printing with a 50% duty cycle from all channels, the guard channels reach the average of the pulse and bias voltages after about 30 ms and when printing with a 90% duty cycle at 5 Hz from all the channels, the guard channels reach the bias voltage plus 90% of the pulse voltage after about 30 ms as shown in FIG. 3.

Figure 4:
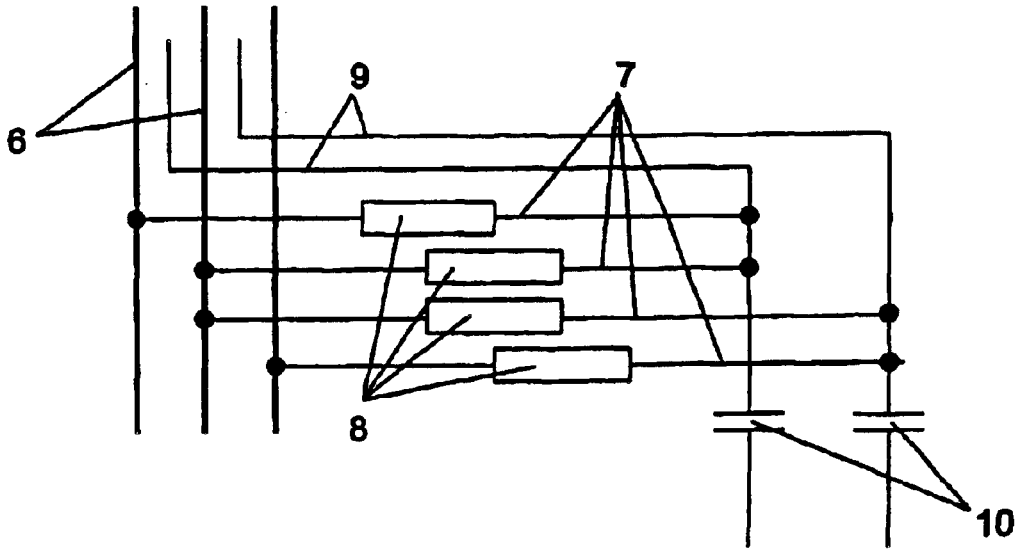
FIG. 4 illustrates alternative electrical connections to the ejector and guard channels of a printer.

It should be noted that in the circuit shown in FIG. 2, the guard channel conductors 9 are all connected together and the RC average of all ejection channels 4 is applied to the guard channel electrodes 50 thereby. A more complex, but advantageous approach to the electrical connections is as shown in FIG. 4, in which an isolated guard channel electrode 50 has the RC average voltage of the two neighbouring printing/ejection channels 4 applied to it (via the conductors 9), by virtue of the bias voltage being applied individually to each guard channel 5 through a respective 100 pF capacitance, and each guard channel conductor 9 being individually connected to the two adjacent ejection channels through a 100MΩ resistance 8.

Figure 5:
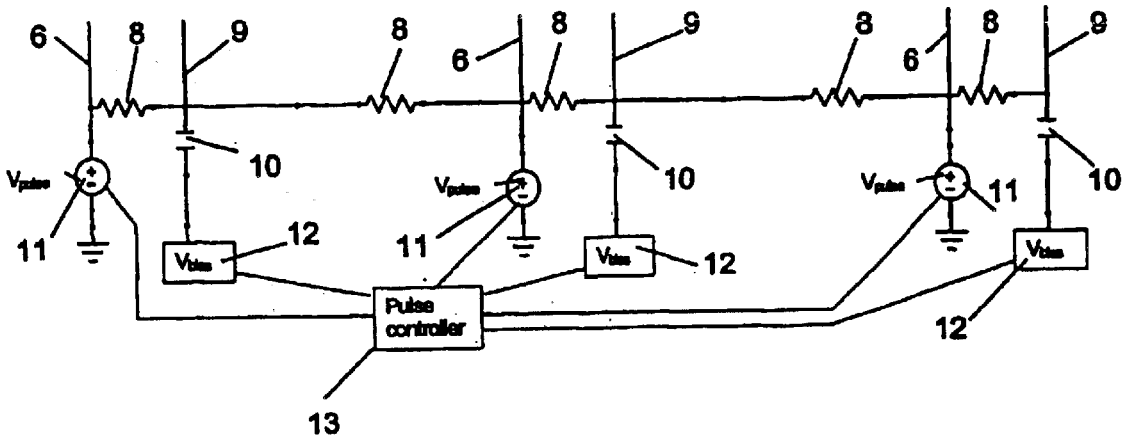
FIG. 5 illustrates a circuit for providing the voltages required.

FIG. 5 illustrates a circuit capable of providing the required voltages to the respective ejection and guard channels and uses the same nomenclature/reference numerals. Pulse voltage generators are illustrated at 11 and a common bias voltag generator is indicated at 12, both being controlled by a suitable controller 13.

Figure 6:
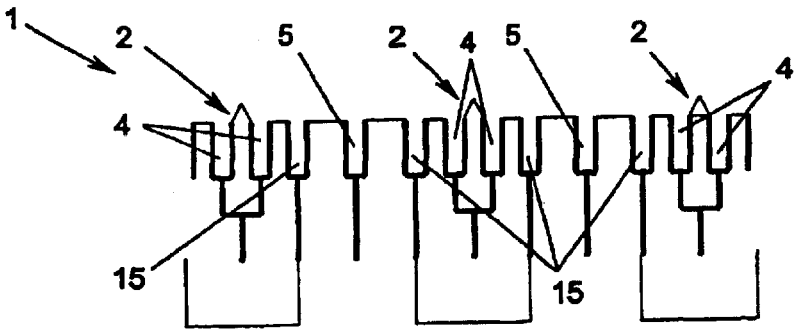
FIG. 6 illustrates an alternative design of print head, similar to that of FIG. 1, but employing multiple guard channels between adjacent electrode locations.

The print head illustrated in FIG. 6 is very similar to that shown in FIG. 1 and the same reference numerals are used. However, the print head has three guard channel is 5, 15, between the adjacent ejection locations 2, the outer pair of channel is 15 being arranged as 'flanker' channels and having their respective associated electrodes (not shown) electrically connected to each other and to the ejection electrode they surround. In this case, the central guard channel 5, can be maintained at the average of the ejection electrodes as described previously. In an alternative (not shown) the flanker channels 15 adjacent to the central guard channel l 5 are connected together and to the guard channel they surround and can b maintained at the average of the ejection electrodes as described previously.

What is claimed is:

1. A drop-on-demand printer having a row of ink ejection locations for ejecting plural ink droplets, each ejection location having an associated ejection electrode to which a voltage is applied for causing electrostatic ejection of the droplets from the respective ejection location;

a guard channel disposed between adjacent ejection locations, each guard channel having an electrode disposed therein; and control means for applying a voltage to said guard channel electrodes, said applied voltage being the average of the voltages applied in operation over a given time to the adjacent ejection location electrodes.

2. A drop-on-demand printer according to claim 1, wherein the control means also applies a bias voltage to the guard channel electrodes, with which the average voltage is summed.

3. A drop-on-demand printer according to claim 2, wherein each guard channel electrode is connected to a bias voltage through a capacitance.

4. A drop-on-demand printer according to claim 1, wherein each guard channel electrode is connected to the adjacent ejection location electrodes through resistances of equal value.

5. A drop-on-demand printer according to claim 1, including plural guard channels between adjacent electrode locations.

6. A drop-on-demand printer having a row of ink ejection locations for ejecting plural ink droplets, each ejection location having an associated ejection electrode to which a voltage is applied for causing electrostatic ejection of the droplets from the respective ejection location;

a guard channel disposed between adjacent ejection locations, each guard channel having an electrode disposed therein; and control means for applying a voltage to said guard channel electrodes, said applied voltage being the average of the voltages applied in operation over a given time to the ejection location electrodes.

7. A drop-on-demand printer according to claim 6, wherein each guard channel electrode is connected to each ejection location electrode through resistances of equal value.

8. A method of operating a drop-on-demand printer having a row of ink ejection locations for ejecting plural ink droplets, each ejection location having an associated ejection electrode for causing electrostatic ejection of the droplets from the respective ejection location, and a guard channel disposed between adjacent ejection locations and having an electrode disposed therein, the method comprising applying a voltage to said guard channel electrodes, said applied voltage being the average of the voltages applied in operation over a given time to the adjacent ejection location electrodes.

9. A method according to claim 8, wherein a common bias voltage is applied to said guard channel electrodes.

10. A method according to claim 9, wherein said common bias voltage is applied through a capacitance.

11. A method according to claim 8, wherein said average voltage is applied by connecting each guard channel electrode to the adjacent ejection location electrodes through resistances of equal value.

12. A method of operating a drop-on-demand printer having a row of ink ejection locations for ejecting plural ink droplets, each ejection location having an associated ejection electrode for causing electrostatic ejection of the droplets from the respective ejection location, and a guard channel disposed between adjacent ejection locations and having an electrode disposed therein, the method comprising applying a voltage to said guard channel electrodes, said applied voltage being the average of the voltages applied in operation over a given time to the ejection location electrodes.

13. A method according to claim 12, wherein said average voltage is applied by connecting each guard channel electrode to the ejection location electrodes through resistances of equal value.

14. A drop-on-demand printer having a row of ink ejection locations for ejecting plural ink droplets, each ejection location having an associated ejection electrode to which a voltage is applied for causing electrostatic ejection of the droplets from the respective ejection location; a plurality of guard channels disposed between adjacent ejection locations, each guard channel having an electrode disposed therein; and control means for applying a voltage to at least some of said guard channel electrodes.

* * * * *